US005980062A

United States Patent [19]

Bell

[11] Patent Number: 5,980,062

[45] Date of Patent: Nov. 9, 1999

[54] BLINKING ILLUMINATED PRODUCT BOX

[76] Inventor: Lucille M. Bell, 1696 Dean Ct., Reynoldsburg, Ohio 43068

[21] Appl. No.: 09/037,815

[22] Filed: Mar. 10, 1998

Related U.S. Application Data

[63] Continuation-in-part of application No. 08/570,704, Dec. 11, 1995.

[51] Int. Cl.[6] ..... F21L 15/08

[52] U.S. Cl. ..... 362/184; 362/154; 362/806; 362/800

[58] Field of Search ..... 362/184, 249, 362/250, 252, 234, 253, 806, 800, 154; 40/564, 571, 574

[56] References Cited

U.S. PATENT DOCUMENTS

| | | |
|---|---|---|
| D. 278,420 | 4/1985 | Thompson . |
| D. 325,672 | 4/1992 | Baker . |
| 3,666,937 | 5/1972 | Franc . |
| 3,700,879 | 10/1972 | Franc . |
| 3,720,825 | 3/1973 | Franc . |
| 3,732,414 | 5/1973 | Franc . |
| 3,737,648 | 6/1973 | Franc . |
| 3,740,543 | 6/1973 | Franc . |
| 3,883,730 | 5/1975 | Dickson . |
| 3,937,320 | 2/1976 | Chao et al. . |
| 3,938,132 | 2/1976 | Cunningham . |
| 4,055,014 | 10/1977 | Schmidt et al. . |
| 4,076,976 | 2/1978 | Fenton . |
| 4,363,081 | 12/1982 | Wilbur . |
| 4,497,126 | 2/1985 | Dejean . |
| 4,607,747 | 8/1986 | Steiner . |
| 5,052,263 | 10/1991 | Feng . |
| 5,113,325 | 5/1992 | Eisenbraun . |
| 5,147,129 | 9/1992 | Ming-ho . |
| 5,217,286 | 6/1993 | Ming-ho . |
| 5,289,917 | 3/1994 | Chabria . |
| 5,329,433 | 7/1994 | Geeting et al. . |
| 5,408,771 | 4/1995 | Manrubia . |

*Primary Examiner*—Thomas M. Sember
*Attorney, Agent, or Firm*—Christen M. Millard; Kremblas, Foster, Millard & Pollick

[57] ABSTRACT

The blinking illuminated product box is a box on which are blinking, battery operated lights of either multi-color or singular color which emit light in a variety of blinking patterns. The boxes are constructed in a variety of shapes and sizes, colors and patterns. The externally mounted light-emitting diodes are on the sides of the box, the top of the box, or on the top and sides of the box. The light-emitting diode multi-wired unit is turned on and off by a slide switch which is part of the multi-battery pack. The pack is mounted in the inside of the box. Rubber o-rings are used to mount the light-emitting diodes in place. A false bottom or top of card stock paper, foam or other suitable material such as a felt or other decorative material is placed in the box to provide protection and visual obstruction of some or all of the wires.

10 Claims, 3 Drawing Sheets

BLINKING ILLUMINATED PRODUCT BOX

CROSS-REFERENCES TO RELATED APPLICATIONS

This is a continuation-in-part of application 08/570,704, filed Dec. 11, 1995, the disclosure of which is incorporated herein by reference.

BACKGROUND OF THE INVENTION

1. Field of the Invention

This invention relates to a blinking illuminated product box, and more particularly to a gift packaging which uses external light-emitting diodes which blink in a pattern of light on a box.

2. Description Of The Related Art

In the past, gift packaging has been accomplished in a variety of ways. If an individual wanted to wrap a box, he or she would usually select a decorative paper which wrapped around the box and had to be secured in place by tape, glue or other adhesive. A bow or ribbon could be attached to the decorative paper. More recently, boxes which include pre-printed designs have been used in order to avoid the requirement of using decorative paper. What is needed, however, is a packaging which includes a series of light emitting diodes which will allow even less time go and energy to be spent by a consumer in wrapping a gift.

Others have used a variety of means for lighting portions of articles. A variety of patents to Franc, U.S. Pat. Nos. 3,666,937; 3,700,879; 3,720,825; 3,732,414; 3,737,648; and 3,740,543 disclose a variety of ways of lighting paper products. However, none shows the configuration disclosed in the present invention.

Other ways of lighting cards and other paper materials are shown in the patents to Schmidt et al., U.S. Pat. No. 4,055,014; Wilbur, U.S. Pat. No. 4,363,081; Dejean, U.S. Pat. No. 4,497,126; Steiner, U.S. Pat. No. 4,607,747; Feng, U.S. Pat. No. 5,052,263; and Ming-Ho, U.S. Pat. Nos. 5,147,129 and 5,217,286. None of these patents discloses a gift packaging with a light-emitting diode configuration as disclosed in the present application. While some of the products disclosed in these patents may be attached to other types of gift packaging, they are not in themselves gift packaging. Other configurations, used with clothing and jewelry and dissimilar to the present invention, are disclosed in the patents to Fenton, U.S. Pat. No. 4,076,976 and Eisenbraun, U.S. Pat. No. 5,113,325.

Other technologies have been used when lighting a box. Most other patents dealing with lighting a box usually relate to the lighting of the interior of the box or attaching a light to the exterior of the box. These include the patents to Thompson, U.S. Design Pat. No. D278,420; Baker, U.S. Design Pat. No. 325,672; Dickson, U.S. Pat. No. 3,883,730; Chao et al., U.S. Pat. No. 3,937,320; Cunningham, U.S. Pat. No. 3,938,132; Chabria, U.S. Pat. No. 5,289,917; Geeting et al., U.S. Pat. No. 5,329,433; and Manrubia, U.S. Pat. No. 5,408,771. These patents all deal with providing sufficient light to enable a user to see the interior of the box or to see other articles with flashlight-type attachments. These configurations are not useful in the present invention, where the light emitting diodes do not generate a light for illuminating something that cannot be viewed due to insufficient light.

SUMMARY OF THE INVENTION

The present invention is a blinking illuminated product box made of paper. The box includes at least three sides, each side being joined to at least one other side. A plurality of light-emitting diodes protrude through a plurality of apertures in one of the sides of the box. The light-emitting diodes are visible on the exterior surface. A shared battery power source pack is attached to the interior surface of the box. A wire attaches each of the light-emitting diodes to the shared battery power source pack. An o-ring secures each of the light-emitting diodes in place.

The light-emitting diodes may be in a color pattern and may have a variety of blinking patterns of light emission. The battery power source pack may include a switch which controls the flow of power between the shared battery source pack and the light-emitting diodes, one position of the switch giving power to the light-emitting diodes and the other position cutting off the power to the light-emitting diodes.

The box may include a false bottom for protecting the shared battery power source. The false bottom may be made of paper chip board, felt, or foam. The paper the box is made of may be a paper chip board and may have a thickness of about 0.06 inches. The o-rings may be made of rubber.

The present invention has a variety of advantages over prior art packaging. The blinking packaging creates excitement and enhances the gift. In addition, it reduces the time and energy necessary for an individual to wrap or otherwise package a gift.

Figure 1:
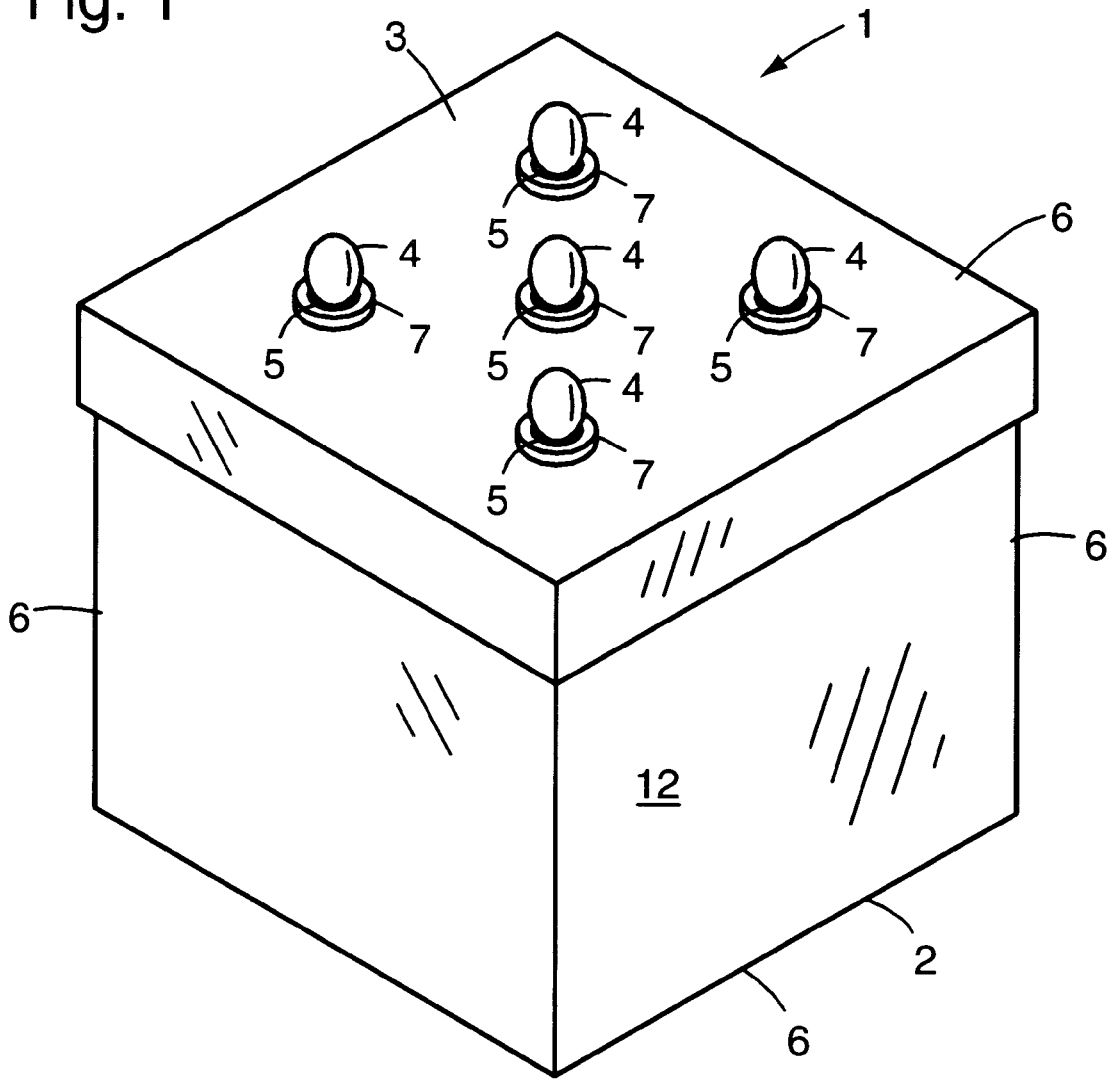
FIG. 1 is a perspective view of a blinking illuminated product box according to the invention in fully assembled form.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art. In addition, many circuits are illustrated which are of a type which perform well known operations on electronic signals. Those skilled in the art will recognize that there are many, and in the future may be additional, alternative circuits which are recognized as equivalent because they provide the same operations on the signals. Further, those skilled in the art will recognize that, under well known principles of Boolean logic, logic levels and logic functions may be inverted to obtain identical or equivalent results.

DETAILED DESCRIPTION OF THE PREFERRED EMBODIMENT

Referring to the Figs., FIG. 1 shows a blinking illuminated product box shown generally at 1. The box 1 as shown in the Figs. has six sides 6. However, one of ordinary skill in the art can easily modify the shape of the box 1 and remain within the scope of the invention. For example, if the box of the invention were a cylindrical box, there would be three sides, two circular and one curved, rectangular side. If the invention were used in connection with a gift bag, which has no closure on one side, the bag would have only five sides. While, in connection with the box 1 shown in the FIGS., it is apparent that there is a bottom 2 with a removable top 3, it is clear that the particular orientation of the box 1 with respect to a surface would make no difference in the scope of the invention and that each side is relatively equivalent. However, considering the various types of gift packaging available, the box 1 must have at lease three sides, as with a cylinder, and may have any larger number sides, since other types of boxes may have many different shapes. In any configuration, each side must be joined to at least one other side, although one or more sides may be removable, such as in the box 1 shown in the FIGS.

The box 1 includes a plurality of light-emitting diodes 4 which protrude through one side 6 through a plurality of apertures S. The particular configuration of the diodes 4 shown in FIG. 1 and the remaining Figs. is an example only and it is apparent that the diodes 4 could protrude from apertures 5 which are located either through any of the sides G. The design, if any, created by the diodes 4 may also vary. The diodes 4 may have any pattern, may have color patterns, and may have a variety of blinking patterns in which they emit light. The diode 4 may be secured in place by a securing mechanism, preferably rubber o-rings 7. The box 1 may be made of any of a variety of materials. However, the material must be strong enough to support the weight of the diodes 4 and the power source to be described in detail below. Preferably, the box 1 is made of paper chip board which has a thickness of 0.06 inches.

Figure 2:
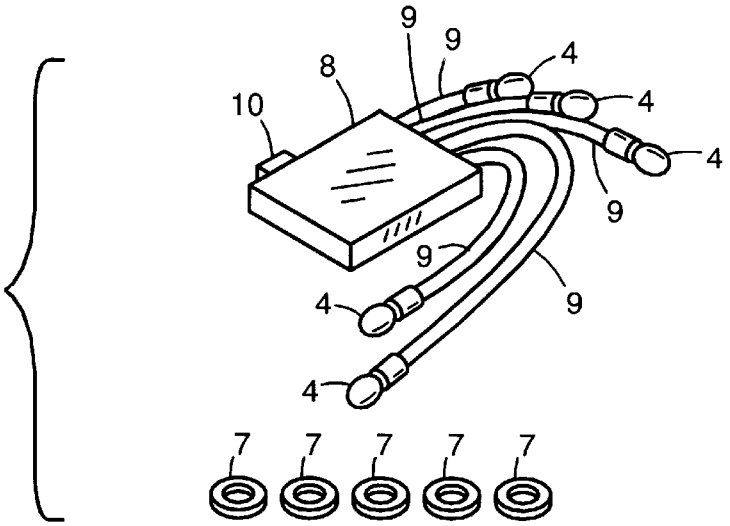
FIG. 2 is a perspective view of a battery power source pack and light-emitting diodes used in connection with the present invention.

FIG. 2 shows the actual light-emitting diode power source. The power source includes a battery power source pack 8 which is shared by the plurality of diodes 4. Each diode is separately connected to the battery pack 8 by a wire 9. The battery pack 8 may be sufficiently large to hold multiple batteries. The battery pack 8 also includes a switch 10 which, in conventional ways, serves to give power to the diodes 4 or to cut off that power. The switch 10 may have two positions, such that in one position, power is given to the diodes 4, and in the other position, power is cut off from the diodes 4.

Figure 3:
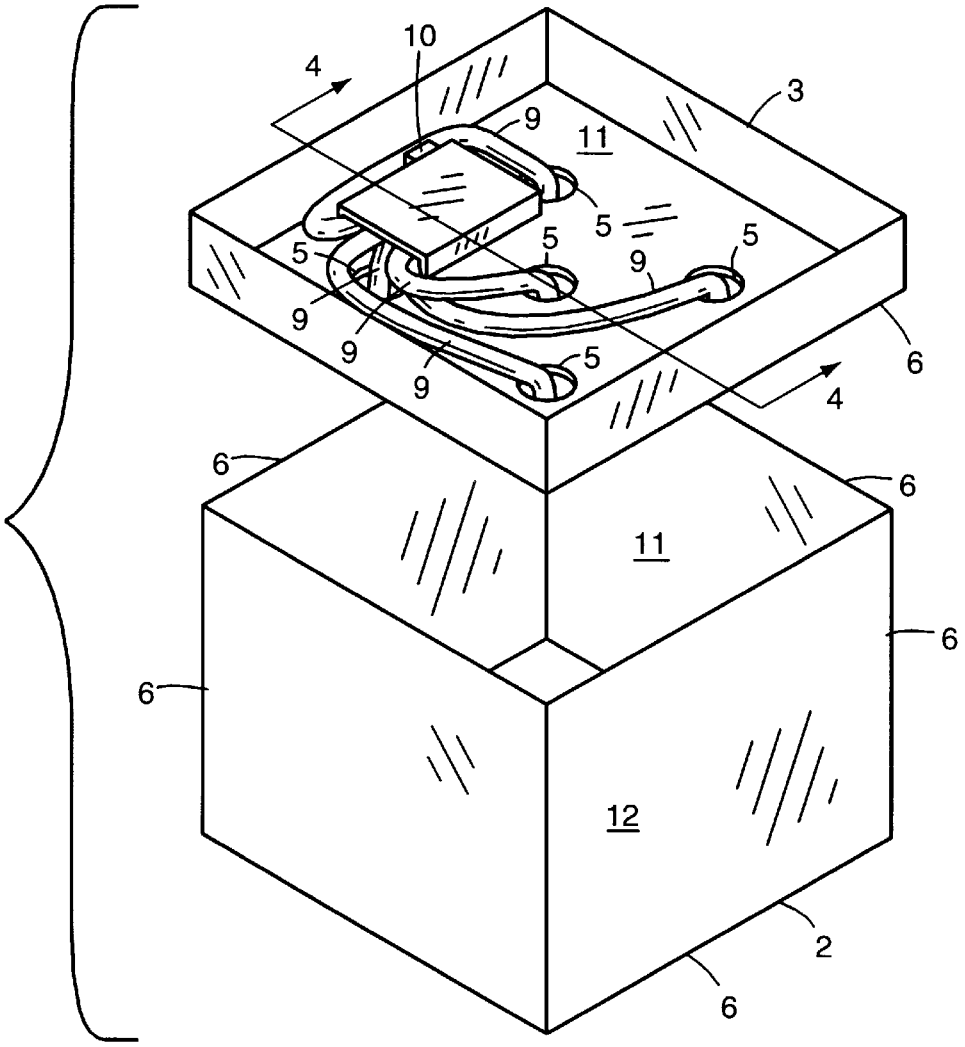
FIG. 3 is a perspective view of a blinking illuminated product box according to the invention shown with the top removed.

FIG. 3 shows the location of the battery pack 8 and wires 9 in the box 1. Each wire 9 extends to a diode 4 which extends through an aperture 5 in a side 6. The light-emitting portions of the diodes 4 are not visible on the interior surface 11 of the box 1. Instead., they are visible primarily on the exterior surface 12 of the box 1. The battery pack 8 is preferably secured to the interior surface 11 of the box 1. It is apparent that the battery pack 8 may be otherwise secured in the interior surface 11 of the box 1, resting on or along any one of the sides 6.

Figure 4:
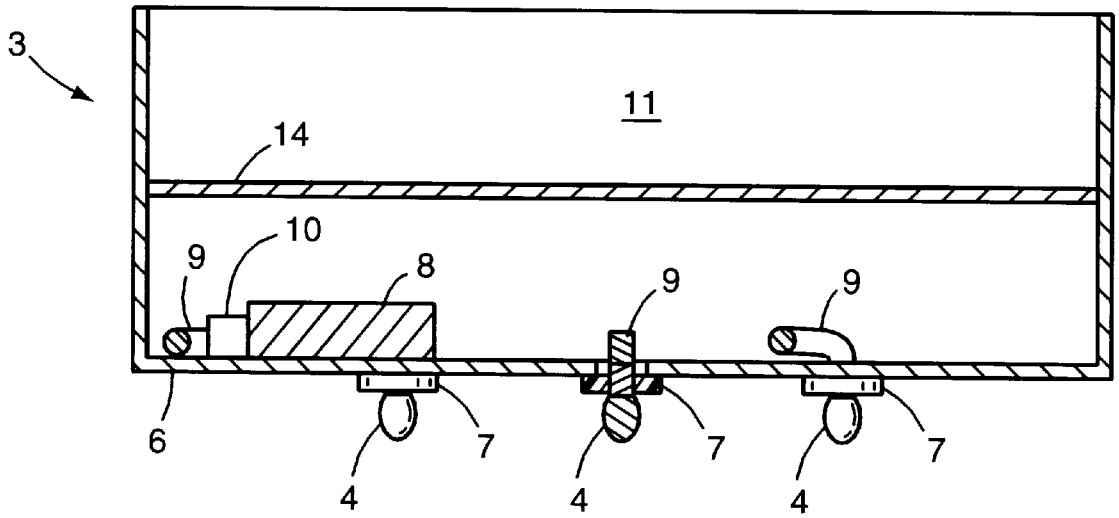
FIG. 4 is a cross-sectional view of the top of the box.

FIG. 4 shows the relative locations of the various portions of the invention with respect to one side 6. A false bottom 14 may also be included as shown in a this Figure. The false bottom 14 is included to improve the aesthetic appearance of the box 1 once the box 1 is opened. The false bottom 14 also serves to protect the battery pack 8 and wires 9 from accidental pulling or the like. The false bottom 14 may be made of the same paper chip board as the rest of the box 1, but may also be made of felt or foam to give added protection to the battery pack 8 and wires 9. The false bottom 14 may also be made of a decorative material to enhance the appearance of the box 1 as a whole. The method by which the false bottom 14 is attached to the box 1 will vary depending on the exact material used for the false bottom 14. For example, if card stock is used, the false bottom may form an interference fit with the box 1. Alternatively, an appropriate adhesive may be required in order to maintain the false bottom 14 within the box 1. The configuration of the false bottom can easily be modified if the battery pack 8 is secured elsewhere on the interior surface 11 of the box 1.

While certain preferred embodiments of the present invention have been disclosed in detail, it is to be understood that various modifications may be adopted without departing from the spirit of the invention or scope of the following claims.

I claim:

1. A blinking illuminated product box made of paper, comprising:

at least three sides, each said side being joined to at least one other said side;

a plurality of light-emitting diodes protruding through a plurality of apertures in at least one of said sides, said plurality of light-emitting diodes being visible on an exterior surface of said box;

a shared battery power source pack attached to an interior surface of said box;

a plurality of wires, each of said wires attaching one of said plurality of light-emitting diodes to said shared battery power source pack; and an o-ring for securing each of said plurality of light-emitting diodes in place.

2. The blinking illuminated product box made of paper according to claim 1, wherein said light-emitting diodes are in a color pattern.

3. The blinking illuminated product box made of paper according to claim 1, wherein said light-emitting diodes have a variety of blinking patterns of light emission.

4. The blinking illuminated product box made of paper according to claim 1, further comprising a switch which gives and cuts off power to said light-emitting diodes from said shared battery power source pack.

5. The blinking illuminated product box made of paper according to claim 1, further comprising a false bottom for protecting said shared battery power source pack.

6. The blinking illuminated product box made of paper according to claim 5, wherein said false bottom is made of a material consisting of paper chip board, felt, or foam.

7. The blinking illuminated product box made of paper according to claim 1, wherein said paper is a paper chip board.

8. The blinking illuminated product box made of paper according to claim 7, wherein said paper is a paper chip board having a thickness of about 0.06 inches.

9. The blinking illuminated product box made of paper according to claim 1, wherein said o-rings are made of rubber.

10. A blinking illuminated product box made of paper assembly comprising:

a quantity of light emitting diodes being mounted to the box through apertures in the box, said light emitting diodes being visual on an external side of the box, said box having a variety of said apertures in a lid of the box and in sides of the box;

the light emitting diodes having their own wires which are joined at a shared battery power source pack;

the light emitting diodes are mounted through the apertures in the lid of the box, and the sides of the box;

the light emitting diodes are in a color pattern with a variety of blinking patterns of light emission;

the battery pack houses multiple batteries which provide power for the light emitting diodes;

an on/off switch on the pack allows an operator to turn the lights on or off;

said apertures further comprising rubber o-rings so that when the lights are pushed through the box apertures, they are secured in place by the rubber o-rings.

* * * * *